US007783240B2

(12) United States Patent
Ito et al.

(10) Patent No.: US 7,783,240 B2
(45) Date of Patent: Aug. 24, 2010

(54) FIXING DEVICE, IMAGE FORMING APPARATUS INCLUDING THE FIXING DEVICE, AND FIXING METHOD

(75) Inventors: Akiko Ito, Machida (JP); Kenji Ishii, Kawasaki (JP); Tadashi Ogawa, Machida (JP); Satoshi Ueno, Kawasaki (JP); Hiroshi Seo, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 184 days.

(21) Appl. No.: 12/071,981

(22) Filed: Feb. 28, 2008

(65) Prior Publication Data

US 2008/0219721 A1 Sep. 11, 2008

(30) Foreign Application Priority Data

Mar. 7, 2007 (JP) ..... 2007-056523

(51) Int. Cl.
*G03G 15/20* (2006.01)

(52) U.S. Cl. ..... 399/328; 219/619; 399/334

(58) Field of Classification Search ..... 219/619; 399/69, 328, 330, 334
See application file for complete search history.

(56) References Cited

U.S. PATENT DOCUMENTS 6,195,525 B1 2/2001 Maeyama
2006/0086719 A1* 4/2006 Suzuki et al. ..... 219/619
2006/0086721 A1 4/2006 Wakahara et al.
2006/0099001 A1 5/2006 Asakura et al.

FOREIGN PATENT DOCUMENTS

| | | |
|---|---|---|
| EP | 1 621 940 | 2/2006 |
| JP | 2975435 | 9/1999 |
| JP | 2001-013805 | 1/2001 |
| JP | 2006-071960 | 3/2006 |

OTHER PUBLICATIONS

European Search Report dated May 6, 2010 for corresponding European Application No. 08250702.

* cited by examiner

*Primary Examiner*—Hoang Ngo
(74) *Attorney, Agent, or Firm*—Harness, Dickey & Pierce, P.L.C.

(57) ABSTRACT

A fixing device includes a magnetic flux generator, a rotating heat generation member, a magnetic flux adjuster, and a driver. The magnetic flux generator generates a magnetic flux. The rotating heat generation member rotates and applies heat to a recording medium bearing an image, and includes a heat-generating layer to generate heat using the magnetic flux generated by the magnetic flux generator. The magnetic flux adjuster is provided outside the rotating heat generation member, and decreases the magnetic flux applied to the heat-generating layer at least in a desired area in an axial direction of the rotating heat generation member. The driver changes the desired area by driving the magnetic flux adjuster in a direction of rotation of the rotating heat generation member.

18 Claims, 10 Drawing Sheets

FIXING DEVICE, IMAGE FORMING APPARATUS INCLUDING THE FIXING DEVICE, AND FIXING METHOD

PRIORITY STATEMENT

The present patent application claims priority from Japanese Patent Application No. 2007-056523 filed on Mar. 7, 2007 in the Japan Patent Office, the entire contents of which are hereby incorporated herein by reference.

BACKGROUND OF THE INVENTION

1. Field of the Invention

Example embodiments generally relate to a fixing device, an image forming apparatus including the fixing device, and a fixing method using, for example, induction heating, implemented by a fixing device incorporated in an image forming apparatus.

2. Description of the Related Art

A related-art image forming apparatus, such as a copier, a printer, a facsimile machine, or a multifunction printer having two or more of copying, printing, scanning, and facsimile functions, forms a toner image on a recording medium (e.g., a recording sheet). For example, an electrostatic latent image formed on an image carrier is visualized with toner into a toner image. The toner image is transferred from the image carrier onto a recording sheet. A fixing device applies heat and pressure to the recording sheet bearing the toner image to fix the toner image on the recording sheet by various methods. Such methods include, for example, a heating roller method, a film method, and an induction heating method.

In a fixing device using the heating roller method, a heat generating source (e.g., a halogen lamp) heats a heating roller. The heating roller opposes a pressing roller to form a fixing nip between the heating roller and the pressing roller so as to nip a recording sheet bearing a toner image therebetween. At the fixing nip, the heating roller and the pressing roller apply heat and pressure to the recording sheet bearing the toner image.

In a fixing device using the film method, a film having a thermal capacity smaller than a thermal capacity of the heating roller is used as a heating member for applying heat to a recording sheet bearing a toner image.

In one example of a fixing device using the induction heating method, an induction heating coil wound around a bobbin is provided inside a heating roller. When an electric current is applied to the induction heating coil, an eddy current is generated in the heating roller and the heating roller generates heat.

In the heating roller method, the heating roller is preheated so that the heating roller may be heated quickly. By contrast, in the induction heating method, the heating roller may be heated up to a desired temperature quickly, even when the heating roller is not preheated.

Another example of a fixing device using the induction heating method includes both an induction heater and a heating roller. The induction heater includes an induction heating coil to which a power source applies a high-frequency voltage. The heating roller includes a magnetic heat-generating layer that has a Curie point equivalent to a fixing temperature. When the power source applies a high-frequency voltage to the induction heater, the heat-generating layer generates heat.

For example, a temperature of a ferromagnet included in the heat-generating layer increases quickly until the temperature of the ferromagnet reaches the Curie point. When the temperature of the ferromagnet reaches the Curie point, the heat-generating layer loses its magnetic property. Thus, the temperature of the ferromagnet does not exceed the Curie point and is maintained at a desired temperature. The Curie point of the ferromagnet is equivalent to the fixing temperature. Therefore, the temperature of the ferromagnet is maintained at the fixing temperature.

The advantage of such an arrangement is that the heating roller may be quickly and precisely heated to a desired temperature without a complex controller, while a surface of the heating roller provides a proper release property and heat resistance.

When the heating roller includes a core and a resin layer having thicknesses and shapes different from each other, the core and the resin layer may have thermal capacities different from each other. However, an amount of ferromagnet particles contained in the heating roller may be adjusted to heat the heating roller quickly and to control the temperature of the heating roller more precisely. Moreover, ferromagnet particles lose their magnetic property when the temperature of the ferromagnet particles reaches the Curie point. Therefore, the heating roller may not attract magnetic particles contained in toner, preventing toner offset.

When the magnetic heat-generating layer has the Curie point equivalent to the fixing temperature, heat generation of the heat-generating layer may be controlled at end and center portions of the heat-generating layer in a width direction (e.g., an axial direction) of the heating roller. Alternatively, overheating of the heat-generating layer may be prevented locally.

In yet another example of a fixing device, a magnetic flux adjuster moves in a circumferential direction of a heating roller to prevent temperature increase at both end portions of the heating roller, serving as a fixing member, in a width direction of the heating roller.

However, the magnetic flux adjuster may be displaced from its proper position in the circumferential direction of the heating roller, and as a result, temperatures of the both end portions of the heating roller may not be controlled properly.

SUMMARY

At least one embodiment may provide a fixing device that includes a magnetic flux generator, a rotating heat generation member, a magnetic flux adjuster, and a driver. The magnetic flux generator generates a magnetic flux. The rotating heat generation member rotates and applies heat to a recording medium bearing an image, and includes a heat-generating layer to generate heat using the magnetic flux generated by the magnetic flux generator. The magnetic flux adjuster is provided outside the rotating heat generation member, and decreases the magnetic flux applied to the heat-generating layer at least in a desired area in an axial direction of the rotating heat generation member. The driver changes the desired area by driving the magnetic flux adjuster in a direction of rotation of the rotating heat generation member.

At least one embodiment may provide an image forming apparatus that includes a fixing device to fix an image on a recording medium. The fixing device includes a magnetic flux generator, a rotating heat generation member, a magnetic flux adjuster, and a driver. The magnetic flux generator generates a magnetic flux. The rotating heat generation member rotates and applies heat to a recording medium bearing an image, and includes a heat-generating layer to generate heat using the magnetic flux generated by the magnetic flux generator. The magnetic flux adjuster is provided outside the rotating heat generation member, and decreases the magnetic flux applied to the heat-generating layer at least in a desired area in an axial direction of the rotating heat generation member. The driver changes the desired area by driving the magnetic flux adjuster in a direction of rotation of the rotating heat generation member.

At least one embodiment may provide a fixing method implemented by a fixing device incorporated in an image forming apparatus. The method includes generating a magnetic flux with a magnetic flux generator, generating heat using the magnetic flux generated with the magnetic flux generator in a heat-generating layer included in a rotating heat generation member, and providing a magnetic flux adjuster outside the rotating heat generation member. The method further includes decreasing the magnetic flux applied to the heat-generating layer at least in a desired area in an axial direction of the rotating heat generation member, changing the desired area by driving the magnetic flux adjuster in a direction of rotation of the rotating heat generation member, and applying heat from the rotating heat generation member to a recording medium bearing an image to fix the image on the recording medium.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
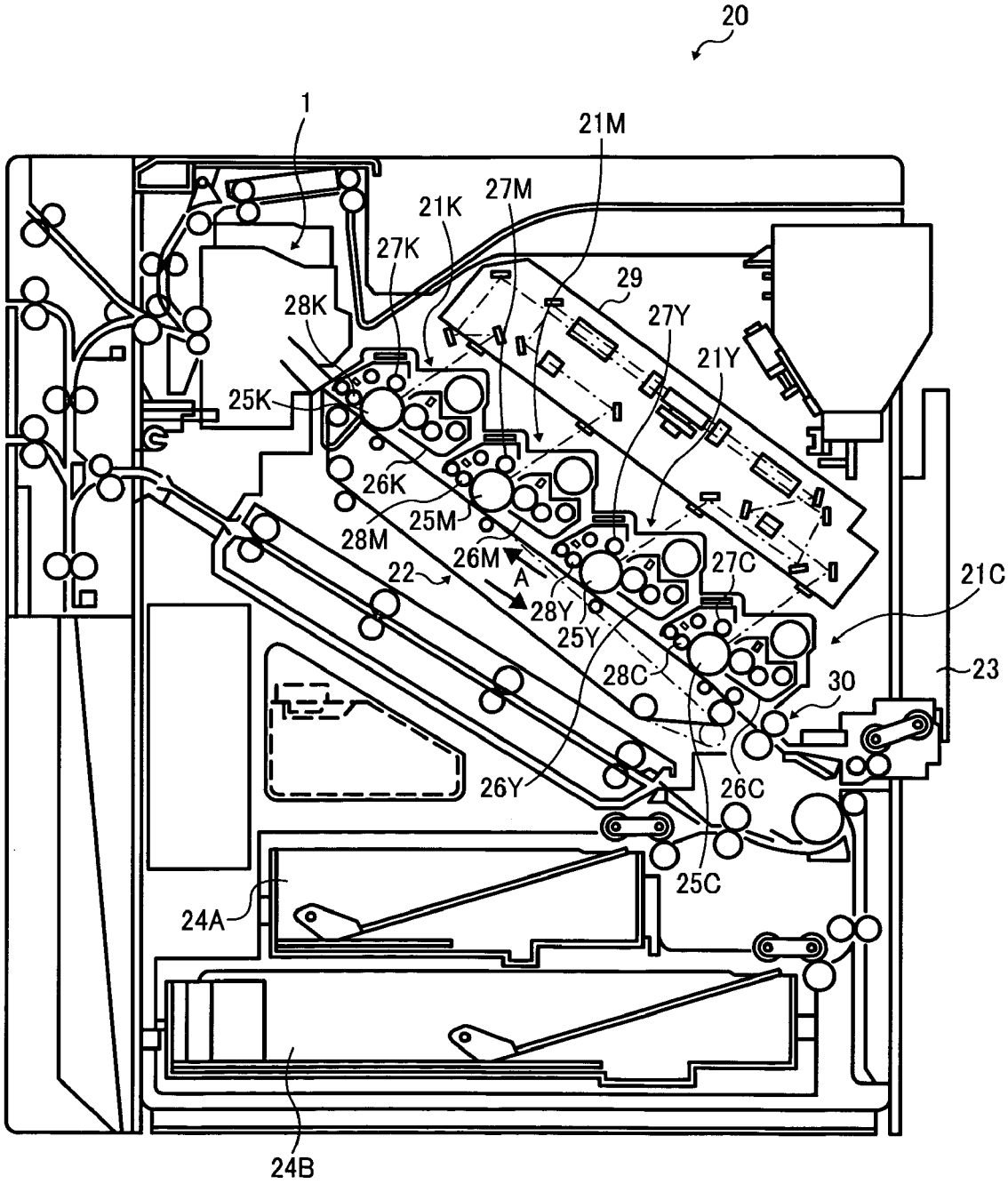
FIG. 1 is a sectional view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms a "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 20 according to an example embodiment is explained.

As illustrated in FIG. 1, the image forming apparatus 20 includes image forming devices 21C, 21Y, 21M, and 21K, a writer 29, a transfer device 22, a bypass tray 23, paper trays 24A and 24B, a registration roller pair 30, and/or a fixing device 1.

The image forming devices 21C, 21Y, 21M, and 21K include photoconductors 25C, 25Y, 25M, and 25K, chargers 27C, 27Y, 27M, and 27K, development devices 26C, 26Y, 26M, and 26K, and/or cleaners 28C, 28Y, 28M, and 28K, respectively.

The image forming apparatus 20 may be a copier, a facsimile machine, a printer, a multifunction printer having two or more of copying, printing, scanning, and facsimile functions, or the like. According to this non-limiting example embodiment, the image forming apparatus 20 functions as a tandem-type color printer for forming a color image on a recording medium (e.g., a recording sheet). However, the image forming apparatus 20 is not limited to the tandem-type color printer and may form a color or monochrome image with other structure.

In the image forming apparatus 20, cyan, yellow, magenta, and black toner images formed on the photoconductors 25C, 25Y, 25M, and 25K, respectively, are directly transferred and superimposed on a recording sheet attracted by a transfer belt serving as a transferor, so as to form a color toner image on the recording sheet.

The image forming devices 21C, 21Y, 21M, and 21K form cyan, yellow, magenta, and black toner images according to cyan, yellow, magenta, and black image data, respectively. The image forming devices 21C, 21Y, 21M, and 21K form toner images in different colors but have a common structure.

The photoconductors 25C, 25Y, 25M, and 25K, serving as an electrostatic latent image carrier, have a drum shape and rotate clockwise in FIG. 1. Alternatively, the photoconductors 25C, 25Y, 25M, and 25K may have a belt shape. The chargers 27C, 27Y, 27M, and 27K, the development devices 26C, 26Y, 26M, and 26K, and the cleaners 28C, 28Y, 28M, and 28K are arranged around the photoconductors 25C, 25Y, 25M, and 25K in this order in a direction of rotation of the photoconductors 25C, 25Y, 25M, and 25K, respectively.

The writer 29 emits light beams onto the photoconductors 25C, 25Y, 25M, and 25K according to cyan, yellow, magenta, and black image data to form electrostatic latent images on the photoconductors 25C, 25Y, 25M, and 25K, respectively. The light beams emitted by the writer 29 travel between the chargers 27C, 27Y, 27M, and 27K and the development devices 26C, 26Y, 26M, and 26K and reach the photoconductors 25C, 25Y, 25M, and 25K, respectively.

The transfer device 22 opposes the image forming devices 21C, 21Y, 21M, and 21K. The transfer device 22 includes a transfer belt (not shown) looped over a plurality of rollers. The transfer belt serves as a transferor and rotates in a direction of rotation A. Transfer bias appliers (not shown) oppose the photoconductors 25C, 25Y, 25M, and 25K, respectively, and apply a transfer bias to the photoconductors 25C, 25Y, 25M, and 25K. An attraction bias applier (not shown) is disposed near the photoconductor 25C from which the cyan toner image is transferred onto a recording sheet on the transfer belt before the yellow, magenta, and black toner images are transferred from the photoconductors 25Y, 25M, and 25K, respectively. The attraction bias applier may contact the transfer belt to apply an attraction bias to the transfer belt, so that the transfer belt attracts a recording sheet before the cyan toner image is transferred from the photoconductor 25C onto the recording sheet. According to this example embodiment, the transfer device 22 is disposed obliquely in the image forming apparatus 20, occupying a decreased space in a horizontal direction in the image forming apparatus 20.

The bypass tray 23 and the paper trays 24A and 24B load recording sheets and serve as sheet suppliers for supplying the recording sheets to a transfer area in which the image forming devices 21C, 21Y, 21M, and 21K oppose the transfer device 22. For example, a recording sheet is fed from the bypass tray 23, the paper tray 24A, or the paper tray 24B toward the registration roller pair 30. The registration roller pair 30 feeds the recording sheet to the image forming devices 21C, 21Y, 21M, and 21K at a proper time at which the cyan, yellow, magenta, and black toner images are transferred from the image forming devices 21C, 21Y, 21M, and 21K onto the recording sheet conveyed by the transfer belt in the transfer area, respectively. The fixing device 1 fixes the toner images transferred on the recording sheet.

According to this example embodiment, the fixing device 1 applies heat and pressure to the recording sheet bearing the toner images. However, the fixing device 1 may apply heat and pressure to a transfer device, which does not oppose a photoconductor via a recording medium (e.g., a recording sheet) but contacts the photoconductor. In this case, the transfer device may perform transfer and fixing operations simultaneously.

The following describes image forming operations performed by the image forming apparatus 20 having the above-described structure. In the following description, the image forming operations of the image forming device 21C for forming a cyan toner image, which are common to the image forming devices 21Y, 21M, and 21K, are explained.

A main motor (not shown) rotates the photoconductor 25C. An AC (alternating current) bias including no DC (direct current) component applied to the charger 27C discharges the photoconductor 25C. Thus, a surface potential of the photoconductor 25C is set to a reference potential of about −50 V. A DC bias, to which the AC bias is superimposed, is applied to the charger 27C. The charger 27C uniformly charges the photoconductor 25C to have a potential equivalent to a DC component. Thus, the photoconductor 25C has a surface potential of from about −500 V to about −700 V. A process controller (not shown) determines a target charging potential.

When the photoconductor 25C is uniformly charged, a writing process is performed. For example, the writer 29 forms an electrostatic latent image according to digital image data sent from a controller (not shown). In the writer 29, a light source (not shown) emits a laser beam in correspondence with a binary signal for laser diode output based on the digital image data per color. The laser beam irradiates the photoconductor 25C via a cylinder lens (not shown), a polygon motor (not shown), an fθ lens (not shown), first, second, and third mirrors (not shown), and a WTL lens (not shown). A portion on the photoconductor 25C irradiated by the laser beam has a surface potential of about −50 V. Thus, an electrostatic latent image corresponding to the digital image data is formed on the photoconductor 25C.

The development device 26C visualizes the electrostatic latent image formed on the photoconductor 25C with toner having a complementary color with respect to a separation color. In a development process, a DC bias of from about −300 V to about −500 V, to which an AC bias is superimposed, is applied to a development sleeve (not shown). Accordingly, the toner is adhered to the electrostatic latent image having a potential decreased by irradiation of the laser beam to form a toner image. The toner has a charge-to-mass ratio (Q/M) of from about −20 μC/g to about −30 μC/g.

The registration roller pair 30 feeds a recording sheet to the photoconductor 25C at a registration time at which the visualized toner image is transferred onto the recording sheet. Before the recording sheet reaches the transfer belt of the transfer device 22, the attraction bias applier, including a roller, applies an attraction bias to the transfer belt, so that the transfer belt electrostatically attracts the recording sheet. In a transfer process, the transfer bias appliers included in the transfer device 22 apply a bias having a polarity opposite to a polarity of the toner to electrostatically transfer and superimpose the toner images from the photoconductors 25C, 25Y, 25M, and 25K onto the recording sheet electrostatically attracted and conveyed by the transfer belt at positions at which the transfer bias appliers oppose the photoconductors 25C, 25Y, 25M, and 25K. Thus, a color toner image is formed on the recording sheet. After the toner image formed on the photoconductor 25C is transferred onto the recording sheet, the cleaner 28C cleans a surface of the photoconductor 25C.

A driving roller (not shown) included in the transfer device 22 separates the recording sheet bearing the color toner image from the transfer belt by using a curvature. The separated recording sheet is conveyed toward the fixing device 1. After the fixing device 1 fixes the color toner image on the recording sheet, the recording sheet bearing the fixed toner image is output onto an internal output tray (not shown) or an external output tray (not shown) when another toner image is not to be formed on the other side of the recording sheet.

Figure 2:
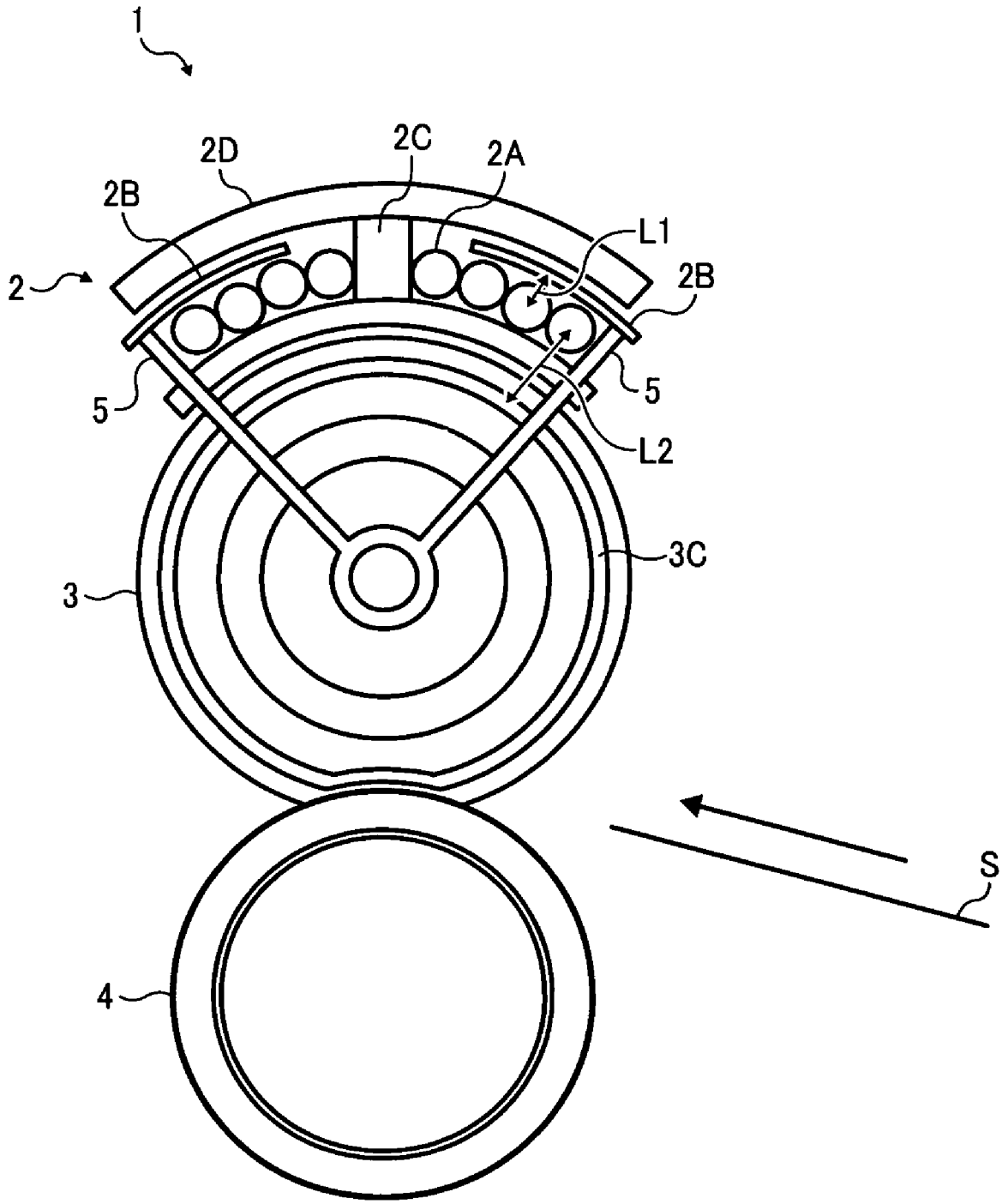
FIG. 2 is a sectional view (according to an example embodiment) of a fixing device included in the image forming apparatus shown in FIG. 1.

FIG. 2 is a sectional view of the fixing device 1. The fixing device 1 includes a magnetic flux generator 2, a fixing roller 3, a pressing roller 4, and/or drivers 5. The magnetic flux generator 2 includes a coil 2A, magnetic flux adjusters 2B, a center core 2C, and/or an arc core 2D. The fixing roller 3 includes a heat-generating layer 3C.

The fixing device 1 includes a pair of rollers for fixing a toner image on a recording sheet S serving as a recording medium. The magnetic flux generator 2 generates a magnetic flux. The fixing roller 3 serves as a rotating heat generation member. The pressing roller 4 serves as a rotating pressing member. The pressing roller 4 pressingly contacts the fixing roller 3 to form a fixing nip. A heat source (not shown) heats the fixing roller 3. When a recording sheet S bearing a toner image passes through the fixing nip, the fixing roller 3 and the pressing roller 4 apply heat and pressure to the recording sheet S to fix the toner image on the recording sheet S.

An inverter (not shown), serving as an induction heating circuit, applies a high frequency current to the coil 2A to generate a high frequency magnetic field. The magnetic field generates an eddy current in the fixing roller 3 including metal so as to increase a temperature of the fixing roller 3. The coil 2A is provided at a position between the arc core 2D and the fixing roller 3. The magnetic flux adjuster 2B is provided at a position between the coil 2A and the arc core 2D. The drivers 5 drive the magnetic flux adjusters 2B. For example, the two drivers 5 move the two magnetic flux adjusters 2B, respectively. The magnetic flux adjusters 2B move between the coil 2A and the arc core 2D in a manner that the magnetic flux adjusters 2B contact to and separate from each other.

A distance L1 denotes a distance between a center of the magnetic flux adjuster 2B and a center of the coil 2A in a diametrical direction (e.g., a direction perpendicular to an axial direction) of the fixing roller 3. A distance L2 denotes a distance between the center of the coil 2A and a center of the heat-generating layer 3C in the diametrical direction (e.g., the direction perpendicular to the axial direction) of the fixing roller 3. The distance L2 may be greater than the distance L1 to decrease the magnetic flux.

Figure 3:
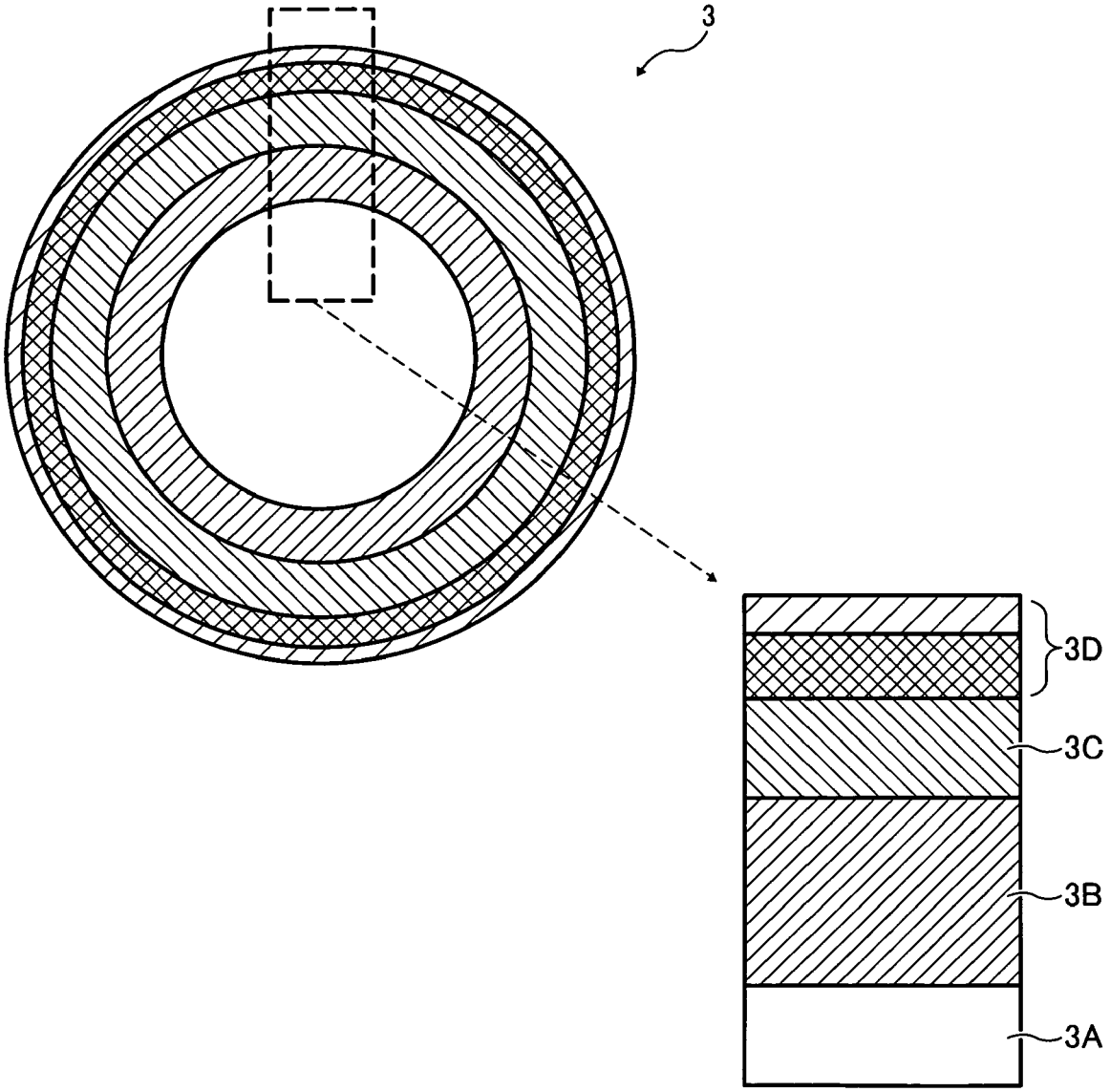
FIG. 3 is a sectional view (according to an example embodiment) of a fixing roller included in the fixing device shown in FIG. 2.

FIG. 3 illustrates a sectional view of the fixing roller 3 and a partially enlarged sectional view of the fixing roller 3. The fixing roller 3 further includes a core 3A, an insulating elastic layer 3B, and/or a surface layer 3D.

The core 3A may include aluminum or an alloy of aluminum. The heat-generating layer 3C may also serve as a magnetic shunt layer. The surface layer 3D may include a silicone rubber layer and a PFA (perfluoroalkoxy) layer.

Figure 4A:
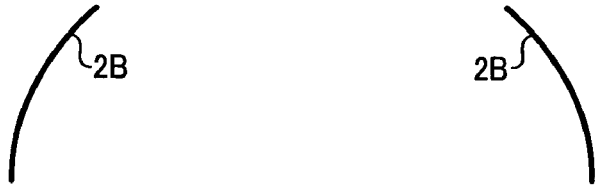
FIG. 4A is a front view (according to an example embodiment) of one example of a magnetic flux adjuster included in the fixing device shown in FIG. 2.
Figure 4B:
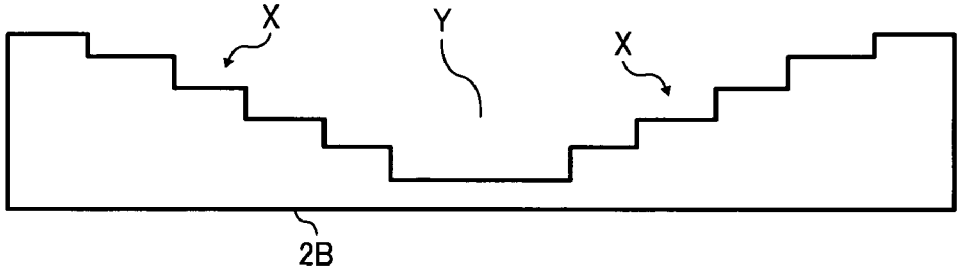
FIG. 4B is a plane view (according to an example embodiment) of the magnetic flux adjuster shown in FIG. 4A.
Figure 4C:
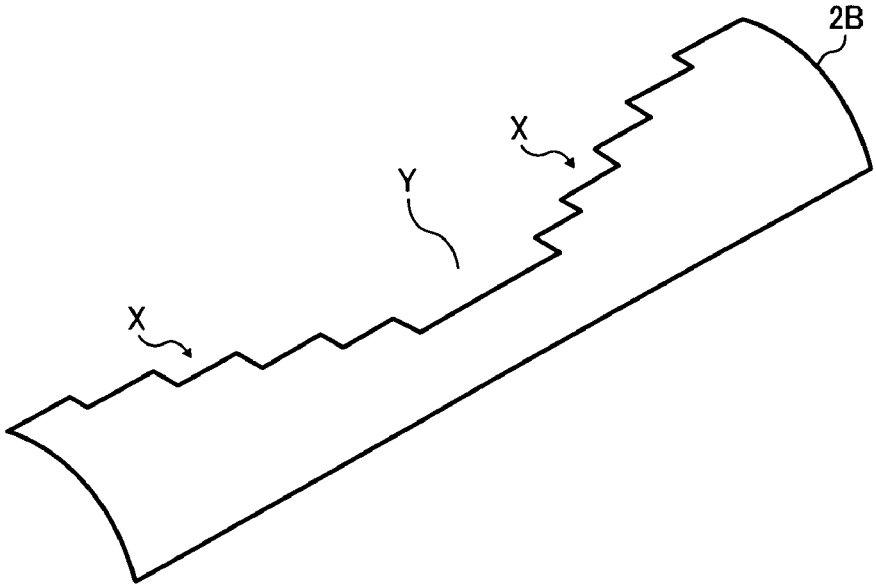
FIG. 4C is a perspective view (according to an example embodiment) of the magnetic flux adjuster shown in FIG. 4A.

FIGS. 4A, 4B, and 4C illustrate an example shape of the magnetic flux adjuster 2B. FIG. 4A is a front view of the magnetic flux adjusters 2B. FIG. 4B is a plane view of the magnetic flux adjuster 2B. FIG. 4C is a perspective view of the magnetic flux adjuster 2B.

As illustrated in FIG. 4A, the magnetic flux adjuster 2B has a curved plate shape. A pair of magnetic flux adjusters 2B may move between the coil 2A and the arc core 2D (depicted in FIG. 2). The drivers 5 (e.g., driving sources) depicted in FIG. 2 drive the magnetic flux adjusters 2B to contact to and separate from each other around a center of an axis of the fixing roller 3 (depicted in FIG. 2). Known mechanisms may be used as the driving source.

As illustrated in FIG. 4B, one edge of the magnetic flux adjuster 2B is cut partially. The cut edges of the magnetic flux adjusters 2B face each other to form a gap between the magnetic flux adjusters 2B. For example, a plurality of steps X forms a gap Y (e.g., a space). Thus, positions of the magnetic flux adjusters 2B may be properly adjusted to adjust a magnetic flux more precisely. The steps X are provided to cause the magnetic flux adjuster 2B to have a width discontinuously varying in a longitudinal direction (e.g., an axial direction) of the fixing roller 3 (depicted in FIG. 2) so as to provide a desired adjustment of magnetic flux. A width of the gap Y is largest at a center portion of the magnetic flux adjuster 2B in the longitudinal direction of the fixing roller 3, so as to provide easy adjustment of magnetic flux at both ends in the longitudinal direction of the fixing roller 3.

Figure 5A:
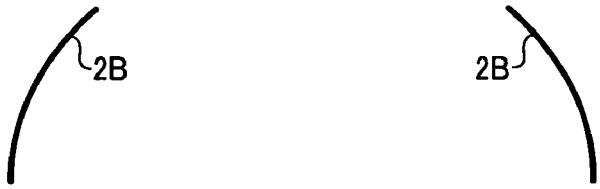
FIG. 5A is a front view (according to an example embodiment) of another example of a magnetic flux adjuster included in the fixing device shown in FIG. 2.
Figure 5B:
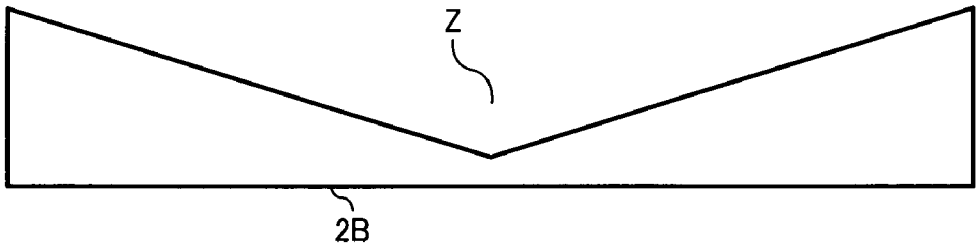
FIG. 5B is a plane view (according to an example embodiment) of the magnetic flux adjuster shown in FIG. 5A.
Figure 5C:
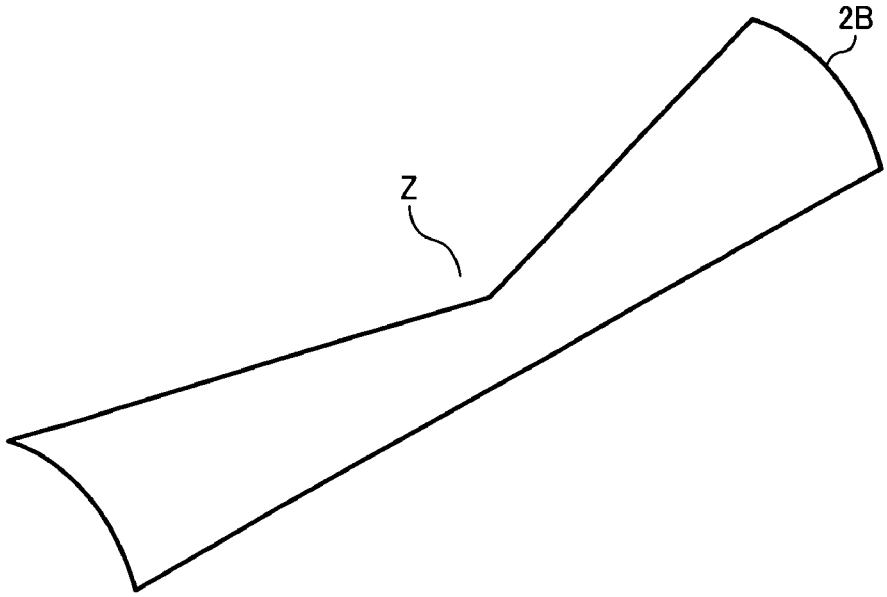
FIG. 5C is a perspective view (according to an example embodiment) of the magnetic flux adjuster shown in FIG. 5A.

FIGS. 5A, 5B, and 5C illustrate another example shape of the magnetic flux adjuster 2B. FIG. 5A is a front view of the magnetic flux adjusters 2B. FIG. 5B is a plane view of the magnetic flux adjuster 2B. FIG. 5C is a perspective view of the magnetic flux adjuster 2B.

The magnetic flux adjuster 2B illustrated in FIGS. 5A, 5B, and 5C has a basic structure common to the magnetic flux adjuster 2B illustrated in FIGS. 4A, 4B, and 4C. For example, as illustrated in FIG. 5B, one edge of the magnetic flux adjuster 2B is cut in a manner that a cut portion forms a triangle in a plane view. The cut edges of the magnetic flux adjusters 2B face each other to form a gap Z (e.g., a space) between the magnetic flux adjusters 2B. A dimension of the gap Z continuously varies in the longitudinal direction of the fixing roller 3 (depicted in FIG. 2). Thus, positions of the magnetic flux adjusters 2B may be properly adjusted to adjust a magnetic flux more precisely. Like the gap Y illustrated in FIG. 4B, a width of the gap Z is largest at a center portion of the magnetic flux adjuster 2B in the longitudinal direction of the fixing roller 3, so as to provide easy adjustment of magnetic flux at both ends in the longitudinal direction of the fixing roller 3.

The gap Y (depicted in FIG. 4B) and the gap Z (depicted in FIG. 5B) may have various shapes and structures. The width of the gaps Y and Z may be largest at any portion other than the center portion of the magnetic flux adjuster 2B. Namely, the largest and smallest widths of the magnetic flux adjuster 2B may be positioned at any portion of the magnetic flux adjuster 2B as long as the positions of the largest and smallest widths of the magnetic flux adjuster 2B are suitable for the fixing device 1 (depicted in FIG. 2).

Figure 6A:
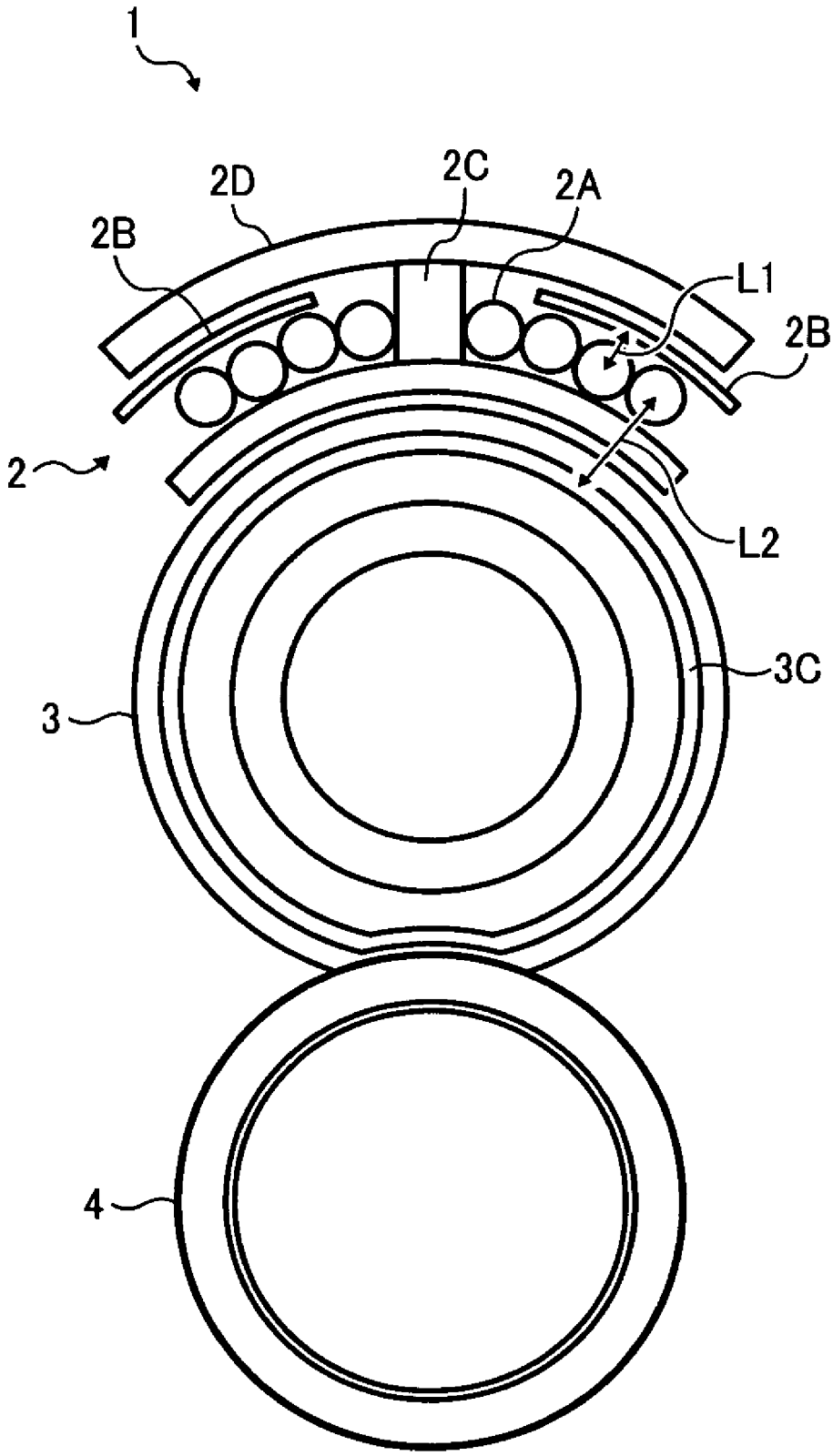
FIG. 6A is a sectional view (according to an example embodiment) of the fixing device shown in FIG. 2 illustrating a first adjustment method for adjusting a magnetic flux.
Figure 6B:
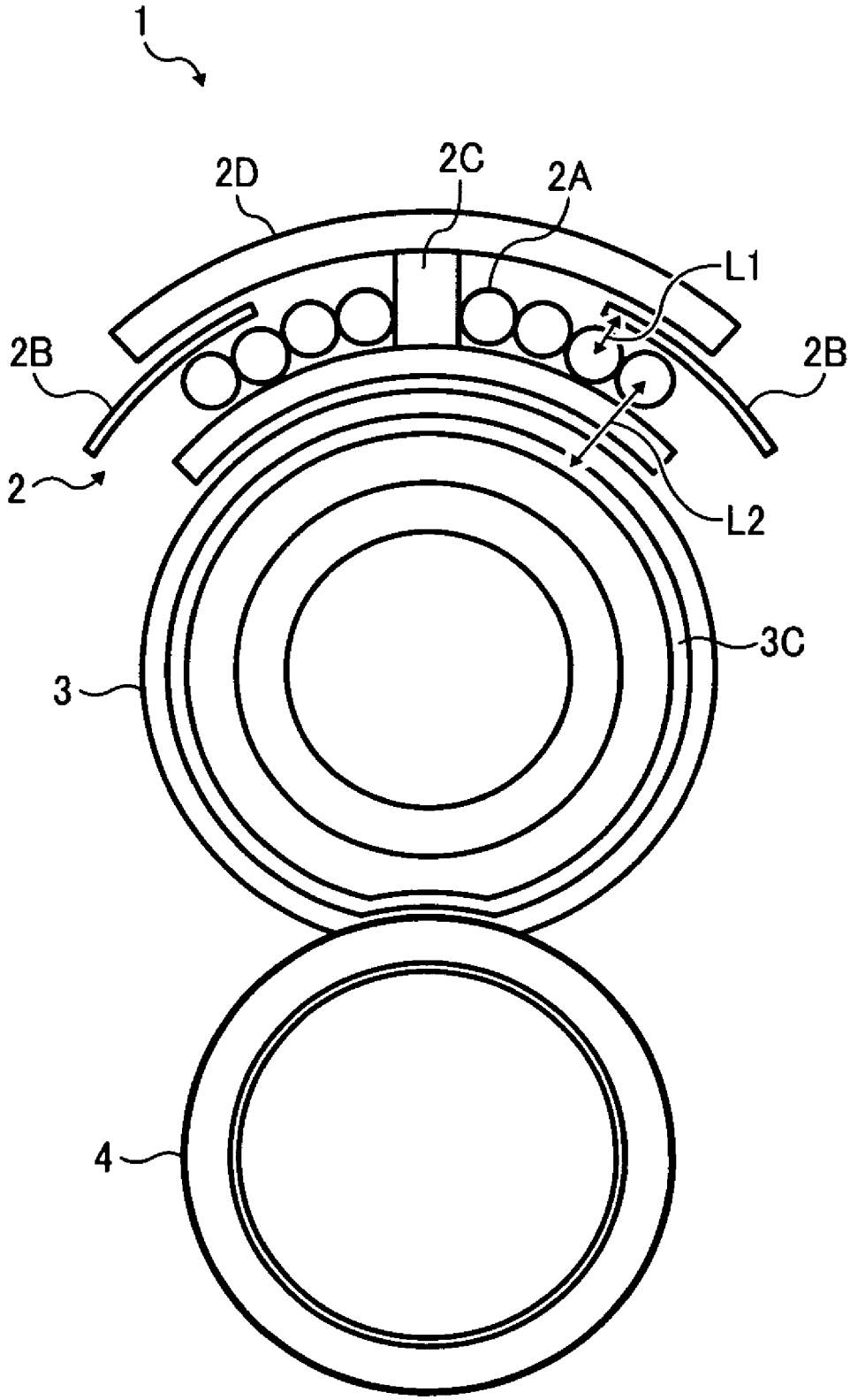
FIG. 6B is a sectional view (according to an example embodiment) of the fixing device shown in FIG. 2 illustrating a second adjustment method for adjusting a magnetic flux.
Figure 6C:
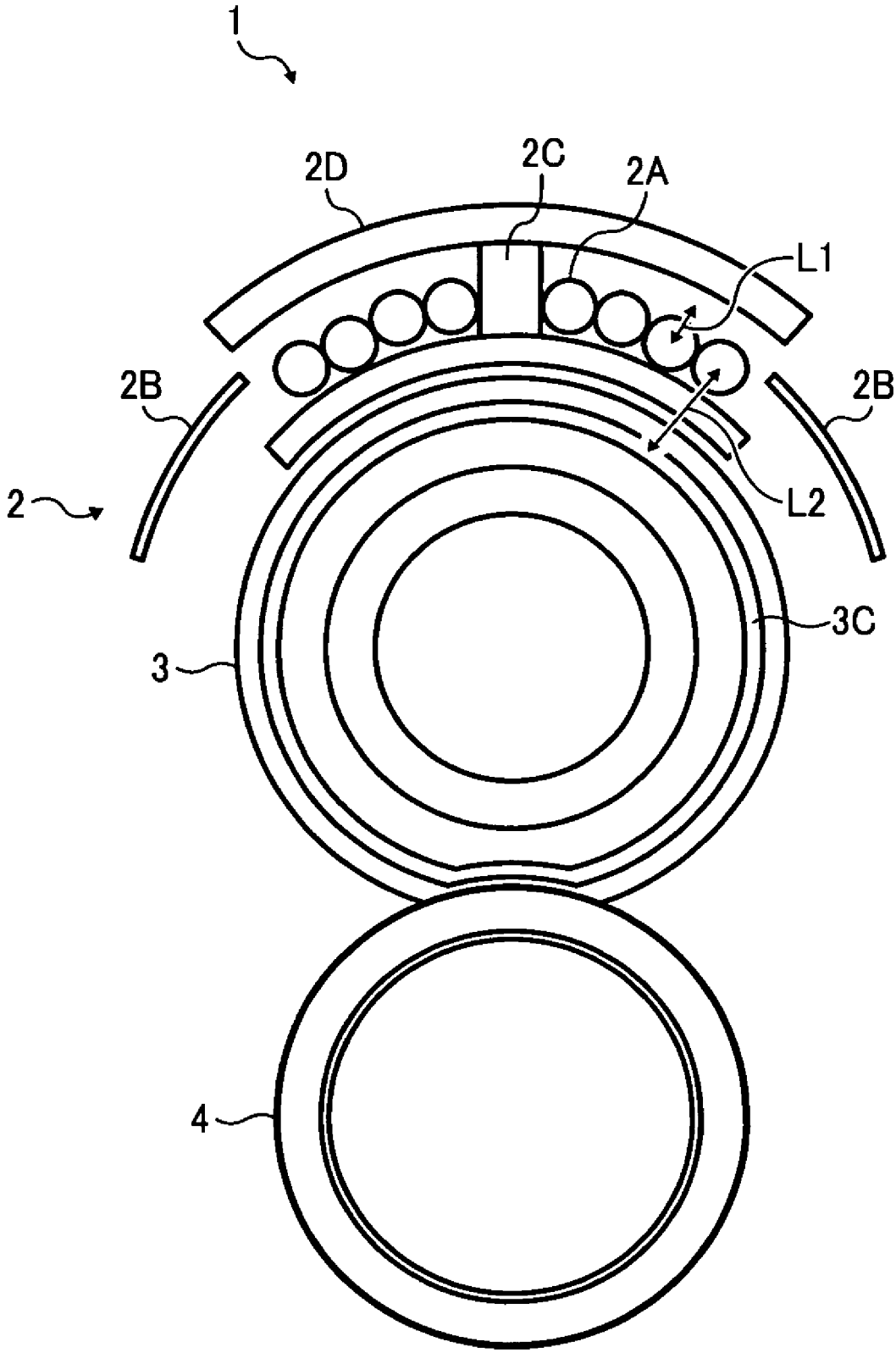
FIG. 6C is a sectional view (according to an example embodiment) of the fixing device shown in FIG. 2 when magnetic flux adjustment is not performed.

Referring to FIGS. 6A, 6B, and 6C, the following describes operations of the fixing device 1. According to this example embodiment, the pressing roller 4 applies pressure to the fixing roller 3 to form a nip between the pressing roller 4 and the fixing roller 3. The pressure applied to the fixing roller 3 deforms the fixing roller 3 to have a concave shape at the nip. When a recording sheet S (depicted in FIG. 2) passes through the nip formed between the pressing roller 4 and the fixing roller 3, the recording sheet S may easily separate from the pressing roller 4 and the fixing roller 3. When the pressing roller 4 presses the fixing roller 3, the surface layer 3D, the heat-generating layer 3C, and/or the insulating elastic layer 3B (depicted in FIG. 3) are deformed and the core 3A (depicted in FIG. 3) is not deformed.

FIG. 6A is a sectional view of the fixing device 1 illustrating a first adjustment method for adjusting a magnetic flux performed by the magnetic flux adjusters 2B. The magnetic flux adjusters 2B are almost entirely sandwiched between the coil 2A and the arc core 2D. The gap Y (depicted in FIG. 4B) or the gap Z (depicted in FIG. 5B) formed by the magnetic flux adjusters 2B may provide relatively strong suppression of temperature increase at both end portions in the longitudinal direction of the fixing roller 3.

FIG. 6B is a sectional view of the fixing device 1 illustrating a second adjustment method for adjusting a magnetic flux performed by the magnetic flux adjusters 2B. The magnetic flux adjusters 2B are partially sandwiched between the coil 2A and the arc core 2D. For example, the magnetic flux adjusters 2B in the second adjustment method protrude from a gap formed between the coil 2A and the arc core 2D in a circumferential direction of the fixing roller 3 farther than in the first adjustment method depicted in FIG. 6A. The magnetic flux adjusters 2B may provide relatively weak suppression of temperature increase at both end portions in the longitudinal direction of the fixing roller 3.

FIG. 6C is a sectional view of the fixing device 1 in which the magnetic flux adjusters 2B entirely protrude from the gap formed between the coil 2A and the arc core 2D. The magnetic flux adjusters 2B do not perform magnetic flux adjustment.

The magnetic flux adjusters 2B may move between positions illustrated in FIG. 6A and positions illustrated in FIG. 6C to adjust an effect applied to the fixing roller 3 by a magnetic flux to a desired level. When the magnetic flux adjusters 2B are shifted to improper positions, the magnetic flux adjusters 2B may be moved to proper positions in a circumferential direction, providing easy adjustment of the positions of the magnetic flux adjusters 2B. Namely, since the magnetic flux adjusters 2B are disposed outside the fixing roller 3, the positions of the magnetic flux adjusters 2B may be adjusted with a precision higher than a precision provided by magnetic flux adjusters disposed inside the fixing roller 3. Thus, a temperature of the fixing roller 3 may be controlled more precisely at both end portions in the longitudinal direction of the fixing roller 3. Namely, the fixing device 1 may control the temperature of both end portions in the axial direction of the fixing roller 3 serving as a rotating heat generation member more precisely. Further, the coil 2A serving as a magnetic flux generator may be positioned close to the fixing roller 3 serving as a rotating heat generation member, increasing a heat generation efficiency of the fixing device 1.

Even when each of the magnetic flux adjusters 2B includes the plurality of steps X illustrated in FIG. 4B or slopes illustrated in FIG. 5B to form a space between the opposing magnetic flux adjusters 2B, the positions of the magnetic flux adjusters 2B may be adjusted more precisely.

As illustrated in FIG. 6A, the distance L1 from the center of the magnetic flux adjuster 2B to the center of the coil 2A in the diametrical direction of the fixing roller 3 is shorter than the distance L2 from the center of the coil 2A to the center of the heat-generating layer 3C in the diametrical direction of the fixing roller 3, reducing magnetic fluxes.

Figure 7:
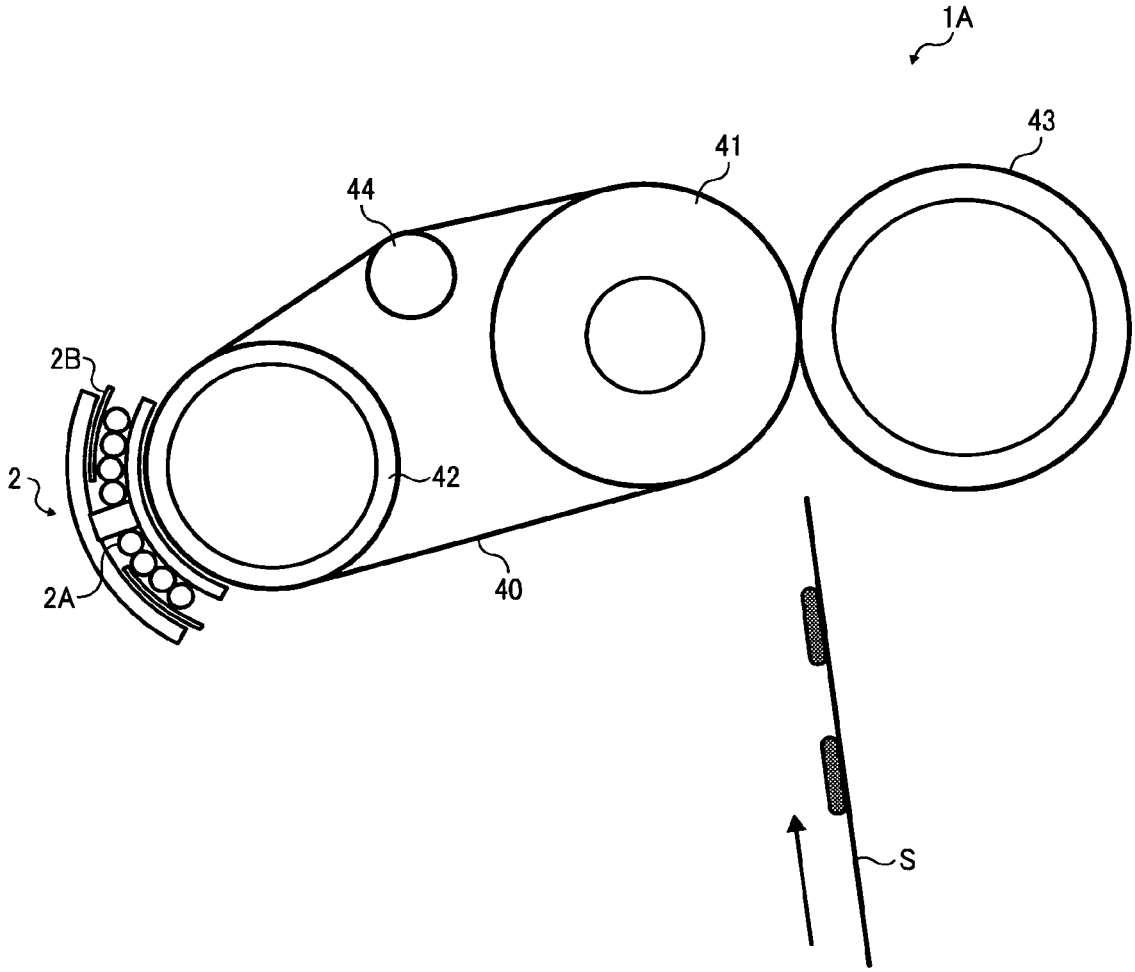
FIG. 7 is a sectional view of a fixing device according to another example embodiment.

FIG. 7 is a sectional view of a fixing device 1A according to another example embodiment. The fixing device 1A includes a fixing belt 40, a fixing roller 41, a heating roller 42, a rotating pressing member 43, and/or a tension roller 44. The other elements of the fixing device 1A are common to the fixing device 1 depicted in FIG. 2.

The fixing belt 40 serves as a rotating heat generation member and is looped over the fixing roller 41 and the heating roller 42. The rotating pressing member 43 opposes the fixing roller 41 via the fixing belt 40 to form a nip between the fixing belt 40 and the rotating pressing member 43. When a recording sheet S bearing a toner image passes through the nip, the fixing belt 40 and the rotating pressing member 43 apply heat and pressure to the recording sheet S to fix the toner image on the recording sheet S. The magnetic flux generator 2 is disposed near the heating roller 42. The fixing belt 40 includes at least a heat-generating layer (e.g., the heat-generating layer 3C depicted in FIG. 3). The fixing belt 40 may include layers common to the layers (e.g., the core 3A, the insulating elastic layer 3B, the heat-generating layer 3C, and the surface layer 3D) illustrated in FIG. 3. The heating roller 42 includes a core including aluminum or an alloy of aluminum. The tension roller 44 applies tension to the fixing belt 40. The fixing device 1A having the above-described structure may also include structural elements for adjusting a magnetic flux and may perform adjustment of magnetic flux common to the fixing device 1.

Figure 8:
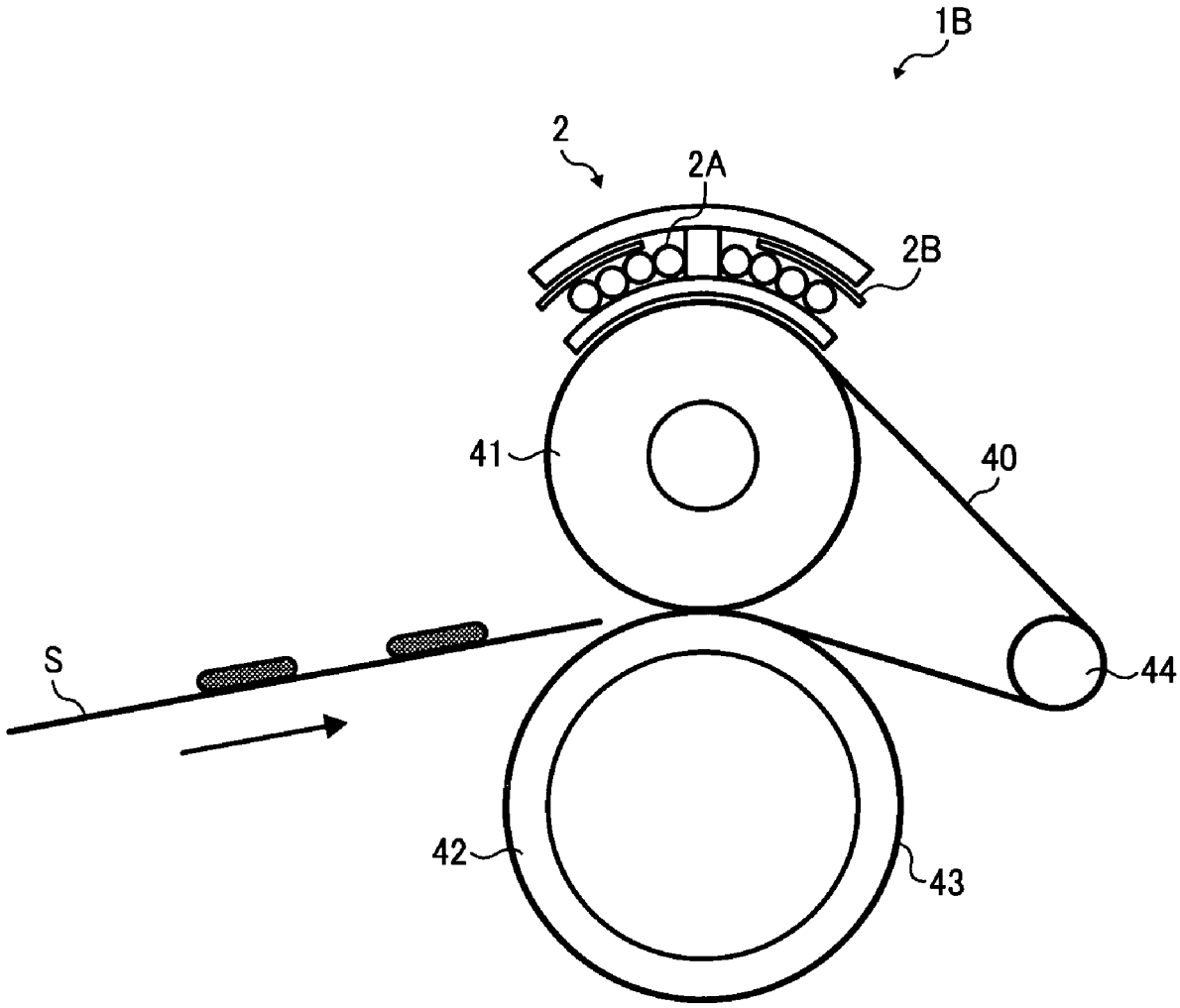
FIG. 8 is a sectional view of a fixing device according to yet another example embodiment.

FIG. 8 is a sectional view of a fixing device 1B according to yet another example embodiment. The fixing device 1B is a modification of the fixing device 1A illustrated in FIG. 7 and includes the elements common to the fixing device 1A. In the fixing device 1B, the fixing roller 42 is provided inside the rotating pressing member 43 and the magnetic flux generator 2 is provided near the fixing roller 41.

According to the above-described example embodiments, the fixing roller 3 (depicted in FIG. 2) or the fixing belt 40 (depicted in FIGS. 7 and 8) serves as a rotating heat generation member. However, the heating roller 42 (depicted in FIGS. 7 and 8) may serve as a rotating heat generation member. In this case, the fixing belt 40 may be looped over the heating roller 42 and a rotating fixing member.

According to the above-described example embodiments, a magnetic flux adjuster (e.g., the magnetic flux adjusters 2B depicted in FIGS. 2, 7, and 8) is provided outside a rotating heat generation member (e.g., the fixing roller 3 depicted in FIG. 2 or the fixing belt 40 depicted in FIGS. 7 and 8). Therefore, a position of the magnetic flux adjuster may be adjusted more precisely. Accordingly, a temperature of end portions of the rotating heat generation member in an axial direction of the rotating heat generation member may be controlled more precisely.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device, comprising:

a magnetic flux generator to generate a magnetic flux;

a rotating heat generation member to rotate and apply heat to a recording medium bearing an image, the rotating heat generation member comprising a heat-generating layer to generate heat using the magnetic flux generated by the magnetic flux generator;

a magnetic flux adjuster provided outside the rotating heat generation member and configured to decrease the magnetic flux applied to the heat-generating layer at least in a desired area in an axial direction of the rotating heat generation member; and a driver configured to change the desired area by driving the magnetic flux adjuster in a direction of rotation of the rotating heat generation member, wherein the magnetic flux adjuster is configured to face an outside surface of the rotating heat generation member.

2. The fixing device according to claim 1, further comprising:

a second magnetic flux adjuster to oppose the first magnetic flux adjuster in the direction of rotation of the rotating heat generation member, wherein each of the first magnetic flux adjuster and the second magnetic flux adjuster has a width discontinuously changing symmetrically about a center portion in a longitudinal direction of the rotating heat generation member.

3. The fixing device according to claim 2,wherein edges of the first magnetic flux adjuster and the second magnetic flux adjuster opposing each other include a plurality of steps for discontinuously changing the widths of the first magnetic flux adjuster and the second magnetic flux adjuster.

4. The fixing device according to claim 3, wherein the plurality of steps of the first magnetic flux adjuster and the second magnetic flux adjuster form a gap between the first magnetic flux adjuster and the second magnetic flux adjuster opposing each other, the gap being largest at the center portion in the longitudinal direction of the rotating heat generation member.

5. The fixing device according to claim 1, further comprising:

a second magnetic flux adjuster to oppose the first magnetic flux adjuster in the direction of rotation of the rotating heat generation member, wherein each of the first magnetic flux adjuster and the second magnetic flux adjuster has a width continuously changing symmetrically about a center portion in a longitudinal direction of the rotating heat generation member.

6. The fixing device according to claim 5, wherein edges of the first magnetic flux adjuster and the second magnetic flux adjuster opposing each other form slopes along the direction of rotation of the rotating heat generation member that continuously change the widths of the first magnetic flux adjuster and the second magnetic flux adjuster.

7. The fixing device according to claim 6, wherein the slopes of the first magnetic flux adjuster and the second magnetic flux adjuster form a gap between the first magnetic flux adjuster and the second magnetic flux adjuster opposing each other, the gap being largest at the center portion in the longitudinal direction of the rotating heat generation member.

8. The fixing device according to claim 1, wherein the magnetic flux generator is provided outside the rotating heat generation member and the magnetic flux adjuster is provided farther away from the rotating heat generation member than the magnetic flux generator.

9. The fixing device according to claim 8, wherein a distance between the magnetic flux adjuster and the magnetic flux generator is shorter than a distance between the magnetic flux generator and the heat-generating layer in a diametrical direction of the rotating heat generation member.

10. The fixing device according to claim 1, further comprising:

a rotating pressing member to pressingly contact the rotating heat generation member, wherein the rotating heat generation member includes one of a fixing sleeve, a fixing roller, and a fixing heat-generating belt, and wherein an image is fixed on a recording medium as the recording medium passes between the rotating heat generation member and the rotating pressing member.

11. The fixing device according to claim 1, wherein the magnetic flux generator is outside the rotating heat generation member.

12. The fixing device according to claim 11, wherein the magnetic flux generator includes an arc core facing the outside surface of the rotating heat generation member and at least one coil between the arc core and the outside surface of rotating heat generation member and the driver is configured to move the magnetic flux adjuster between the arc core and the at least one coil.

13. The fixing device according to claim 1, wherein the rotating heat generation member includes the outside surface extending along a longitudinal axis of the rotating heat generation member and the magnetic flux adjuster includes a surface extending axially along and outside the outside surface of the rotating heat generation member.

14. The fixing device according to claim 13, wherein the magnetic flux generator includes an arc core facing the outside surface of the rotating heat generation member and at least one coil between the arc core and the outside surface of rotating heat generation member and the driver is configured to move the magnetic flux adjuster between the arc core and the at least one coil.

15. An image forming apparatus comprising a fixing device to fix an image on a recording medium, the fixing device comprising:

a magnetic flux generator to generate a magnetic flux;

a rotating heat generation member to rotate and apply heat to a recording medium bearing an image, the rotating heat generation member comprising a heat-generating layer to generate heat using the magnetic flux generated by the magnetic flux generator;

a magnetic flux adjuster provided outside the rotating heat generation member to decrease the magnetic flux applied to the heat-generating layer at least in a desired area in an axial direction of the rotating heat generation member; and a driver to change the desired area by driving the magnetic flux adjuster in a direction of rotation of the rotating heat generation member, wherein the magnetic flux adjuster is configured to face an outside surface of the rotating heat generation member.

16. The image forming apparatus according to claim 15, wherein the magnetic flux generator is outside the rotating heat generation member.

17. The image forming apparatus according to claim 16, wherein the magnetic flux generator includes an arc core facing the outside surface of the rotating heat generation member and at least one coil between the arc core and the outside surface of rotating heat generation member and the driver is configured to move the magnetic flux adjuster between the arc core and the at least one coil.

18. A fixing method implemented by a fixing device incorporated in an image forming apparatus, the fixing method comprising the steps of:

generating a magnetic flux with a magnetic flux generator;

generating heat using the magnetic flux generated with the magnetic flux generator in a heat-generating layer included in a rotating heat generation member;

providing a magnetic flux adjuster outside the rotating heat generation member;

decreasing the magnetic flux applied to the heat-generating layer at least in a desired area in an axial direction of the rotating heat generation member;

changing the desired area by driving the magnetic flux adjuster in a direction of rotation of the rotating heat generation member; and applying heat from the rotating heat generation member to a recording medium bearing an image to fix the image on the recording medium, wherein providing the magnetic flux adjuster outside the rotating heat generation member includes positioning the magnetic flux adjuster to face an outside surface of the rotating heat generation member.

* * * * *